US009427798B2

(12) United States Patent
De Luca et al.

(10) Patent No.: US 9,427,798 B2
(45) Date of Patent: Aug. 30, 2016

(54) TEMPLATE FOR CENTERING ROLLERS AT THE FOOT OF AN INGOT MOLD

(71) Applicant: Danieli & C. Officine Meccaniche S.P.A., Buttrio (IT)

(72) Inventors: Andrea De Luca, Remanzacco (IT); Marco Ansoldi, Udine (IT); Alfredo Poloni, Fogliano Redipuglia (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 75 days.

(21) Appl. No.: 14/405,391

(22) PCT Filed: Jun. 5, 2013

(86) PCT No.: PCT/IB2013/054623

§ 371 (c)(1),
(2) Date: Dec. 3, 2014

(87) PCT Pub. No.: WO2013/183008

PCT Pub. Date: Dec. 12, 2013

(65) Prior Publication Data

US 2015/0290704 A1 Oct. 15, 2015

(30) Foreign Application Priority Data

Jun. 6, 2012 (IT) ..... MI2012A0979

(51) Int. Cl.
*G01B 5/25* (2006.01)
*B22D 11/20* (2006.01)
*B22D 11/128* (2006.01)

(52) U.S. Cl.
CPC ..... *B22D 11/208* (2013.01); *B22D 11/128* (2013.01)

(58) Field of Classification Search
CPC .... B23P 19/12; B22D 11/208; B22D 11/128
USPC ..... 33/613, 644, 645, 562
See application file for complete search history.

(56) References Cited

U.S. PATENT DOCUMENTS 1,448,528 A 3/1923 Elliott
4,523,624 A * 6/1985 Dantzig ..... B22D 11/045 164/413
5,332,024 A * 7/1994 Fasano ..... B22D 11/04 164/154.1

(Continued)

FOREIGN PATENT DOCUMENTS

DE 2645022 A1 4/1978
EP 2334453 A1 6/2011
WO WO2010016036 A1 2/2010

*Primary Examiner* — G. Bradley Bennett
(74) *Attorney, Agent, or Firm* — Stetina Brunda Garred & Brucker

(57) ABSTRACT

A template (1) for centering rollers at the foot of an ingot mold, the ingot mold being provided with a round section crystallizer into which the template can be inserted passing therethrough from a first end to a second end, the template comprising a round section tubular frame (5), defining a longitudinal axis (X) and having a plurality of longitudinal slots (6) arranged at an equal angular distance from one another; a plurality of longitudinal plates (7) configured so that each longitudinal plate is inserted into a respective longitudinal slot (6) and can move in radial direction through said respective longitudinal slot; at least one inflatable chamber (8, 8'), housed into the tubular frame (5) and at least partially covering the longitudinal extension of a frame stretch adapted to remain inside the crystallizer when the template is inserted into said crystallizer, said at least one inflatable chamber being adapted to expand so as to move said longitudinal plates outwards in radial direction to adhere them to the inner wall of the crystallizer.

14 Claims, 4 Drawing Sheets

(56) References Cited

U.S. PATENT DOCUMENTS 5,359,781 A * 11/1994 Melville ..... G01B 11/27 33/286
5,715,888 A * 2/1998 Kaell ..... B22D 11/053 164/416
6,338,379 B2 * 1/2002 Mantovan ..... B23D 11/0608 164/430
7,926,548 B2 * 4/2011 Jacques ..... B22D 11/006 164/415
2004/0093753 A1 * 5/2004 McInroy ..... G01D 11/30 33/613

* cited by examiner

TEMPLATE FOR CENTERING ROLLERS AT THE FOOT OF AN INGOT MOLD

CROSS REFERENCE TO RELATED APPLICATIONS

The present application claims priority to PCT International Application No. PCT/IB2013/054623 filed on Jun. 5, 2013, which application claims priority to Italian Patent Application No. MI2012A000979 filed Jun. 6, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a template for centering rollers at the foot of an ingot mold suitable for casting round section products.

BACKGROUND ART

At present, in order to center the rollers at the foot of an ingot mold, the operator carries out a series of manual operations for adjusting the roller position using a monolithic template designed to be adapted and fixed with shims or spacers to the inner walls of the crystallizer, accommodated inside the ingot mold body, so as to follow the tapers present in the crystallizer walls.

The above manual centering operations, using such a monolithic template, disadvantageously require long times and a good centering is in any case highly depending on the operators' experience and skills.

As an alternative, a centering template may be used which consists of multiple longitudinal elements separate from one another, such as for example that described in document EP2334453. Said longitudinal elements have an outer surface having a shape complementary to respective inner wall portions of the crystallizer, and at least one air chamber is provided, which is accommodated into the template and is adapted to expand so as to adhere the longitudinal elements to the respective inner wall portions of the crystallizer. Such a template is particularly effective for quadrangular section crystallizers and allows a quick and accurate centering of the rollers irrespective of the operators' skills and experience, ensuring the repeatability of the operation of centering. However, disadvantageously, in the case of a round section crystallizer, such a template is not accurate since in this case the edges that characterize a square or rectangular section of the crystallizer against which the longitudinal elements rests, taking on a unique position, are not provided. In the case of round ingot mold, the template described in EP2334453 includes longitudinal elements having an outer surface with a shape substantially complementary to respective inner wall portions of the crystallizer and having a circle arc cross section, but being able to rest each time on different points of the inner surface of the crystallizer. The positioning variability of the longitudinal elements of the template causes inaccuracy in aligning the rollers at the foot, which is thus subject to an error whenever the operation is carried out.

The need of providing a template for centering rollers at the foot of an ingot mold, suitable for casting round section products, which allows the above drawbacks to be overcome, is therefore felt.

SUMMARY OF THE INVENTION

It is the primary object of the present invention to provide a template for centering rollers at the foot of an ingot mold, suitable for casting round section products, which ensures a correct and repeatable positioning thereof, while allowing a quick and accurate centering of said rollers.

It is another object of the invention to provide a template which can self-adapt to the taper of the inner walls of the crystallizer.

It is a further object of the invention to provide a template which may be used on a wide range of crystallizers, both in terms of diameters and in terms of curvature radiuses of the crystallizer axis.

It is a further object of the invention to provide a related method for centering the rollers at the foot of the ingot mold, easy to be carried out with accuracy even by operators having little experience.

Therefore, the present invention aims to achieve the above-discussed objects by providing a template for centering rollers at the foot of an ingot mold, the ingot mold being provided with a round section crystallizer in which the template can be inserted by passing therethrough from a first end to a second end, the template, according to claim 1, comprising:

- a round section tubular frame, defining a longitudinal axis and having at least one plurality of longitudinal slots arranged at an equal angular distance from one another;
- a plurality of longitudinal plates configured so that each longitudinal plate is inserted into a respective longitudinal slot and can move in radial direction through said respective longitudinal slot;
- at least one inflatable chamber, housed inside the tubular frame and at least partially covering the longitudinal extension of a first frame stretch adapted to remain inside the crystallizer when the template is inserted into said crystallizer, said at least one inflatable chamber being adapted to expand so as to move said longitudinal plates outwards in radial direction to adhere them to the inner wall of the crystallizer.

A second aspect of the present invention provides for a method for centering the rollers at the foot of an ingot mold, provided with a round section crystallizer, by using the above template, said method according to claim 12 comprises the following steps:

a) inserting the template into the crystallizer;

b) expanding at least one inflatable chamber whereby the longitudinal plates of the template move radially outwards, through the tubular frame, up to produce a contact of said longitudinal plates with the inner walls of the crystallizer;

c) centering the rollers at the foot by approaching the rollers up to reach a first contact position of said rollers along a generatrix thereof with said longitudinal plates.

A preferred variant of the invention provides for a template consisting of a substantially cylindrical, longitudinal monolithic frame having four longitudinal slots arranged at 90° with respect to one another, in which respective longitudinal plates or blades are positioned, which can only move in radial direction. The template is inserted into the crystallizer and fixed, for example by means of pins, at the upper end thereof so that at each operation it is always positioned in the same way. At least one inflatable chamber, arranged within the frame, is inflated and expands, pushing the blades outwards from the template frame up to abut on the inner surface of the crystallizer. Therefore, the blades only move in radial direction and have no possibility to position themselves at a different angle with respect to one another.

In addition to facilitating the centering operation and significantly reducing the times thereof, the template and method of the invention advantageously allow possible problems to be prevented during the continuous casting process, due to the high centering accuracy achieved, and thus to the high guiding accuracy of the cast product.

The inclusion of a conveniently shaped end edge in the longitudinal plates, such as to perfectly follow the inner taper of the crystallizer, further improves the centering accuracy and the repeatability of the result obtained.

A variant of the template of the invention includes a single air chamber therein, which at least partially covers the longitudinal extension of the template stretch which remains inside the crystallizer.

A further variant of the template of the invention includes two air chambers therein, arranged in positions corresponding to the upper end and to the lower end, respectively, of the crystallizer in which the template is inserted.

Other variants may provide for the use of a number of air chambers higher than two. The template object of the present invention has the following advantages:

- always ensures the same correct positioning with respect to the ingot mold at each operation;
- allows an easy insertion of the template into the ingot mold;
- ensures the correct angular distance of a longitudinal plate or blade to the other;
- allows the rollers to be aligned at the foot of ingot molds in a predetermined range of measures;
- within predetermined ranges of the curvature radius, the template adapts to the ingot mold curvature with the use of shims;
- allows the rollers to be aligned at the foot in a more or less internal position with respect to the crystallizer according to the needs.

The dependent claims describe preferred embodiments of the invention.

BRIEF DESCRIPTION OF THE DRAWINGS

Further features and advantages of the invention will become more apparent from the detailed description of a preferred, but not exclusive, embodiment of a template for centering the rollers at the foot of an ingot mold, by way of a non-limiting example with the aid of the accompanying drawings, in which.

Same reference numerals in different figures identify the same elements or components

DETAILED DESCRIPTION OF A PREFERRED EMBODIMENT OF THE INVENTION

Figure 1A:
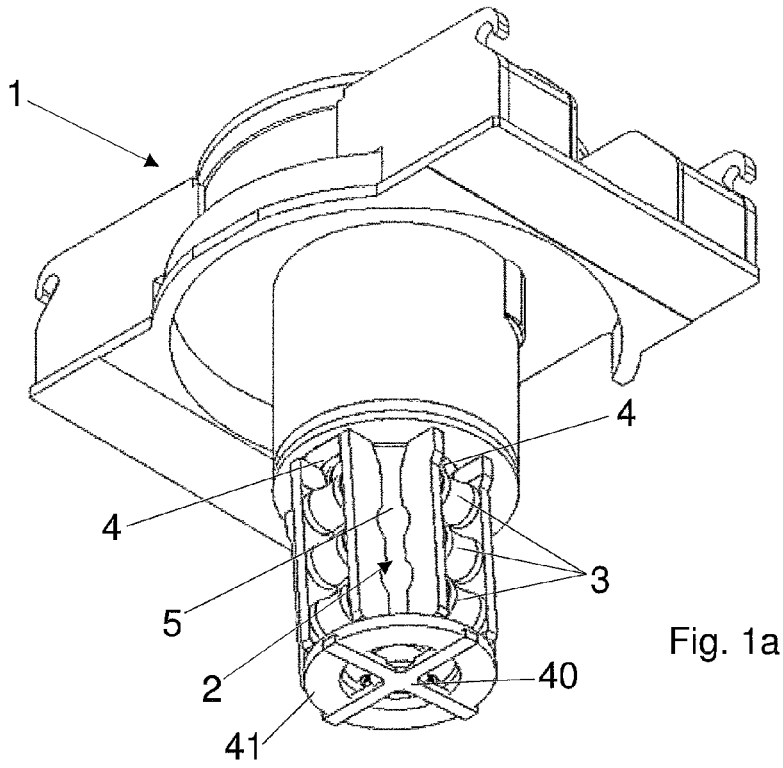
FIG. 1*a* shows an axonometric view of an example of ingot mold provided with foot rollers and in which the template according to the invention is inserted.
Figure 1B:
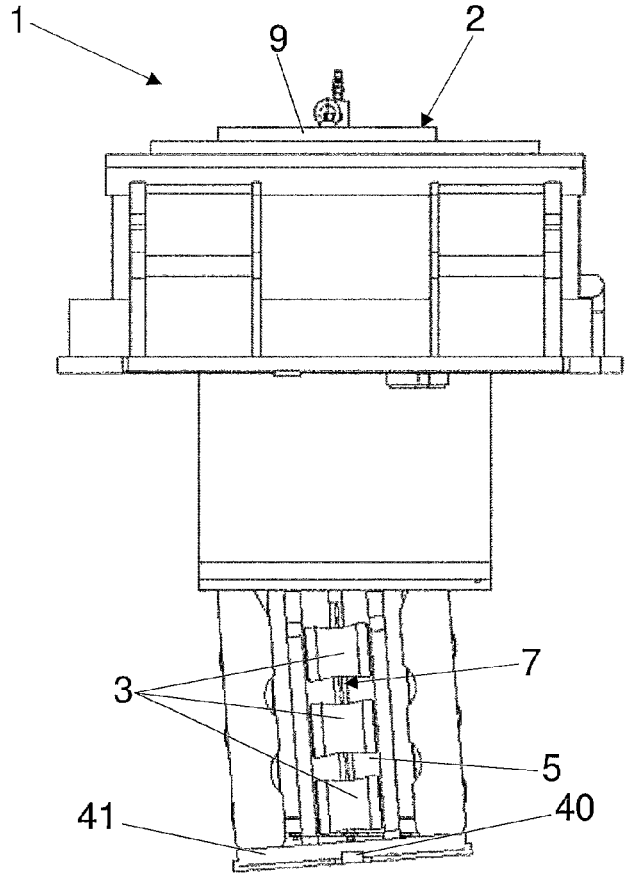
FIG. 1*b* shows a side view of the ingot mold in FIG. 1*a;*
Figure 2:
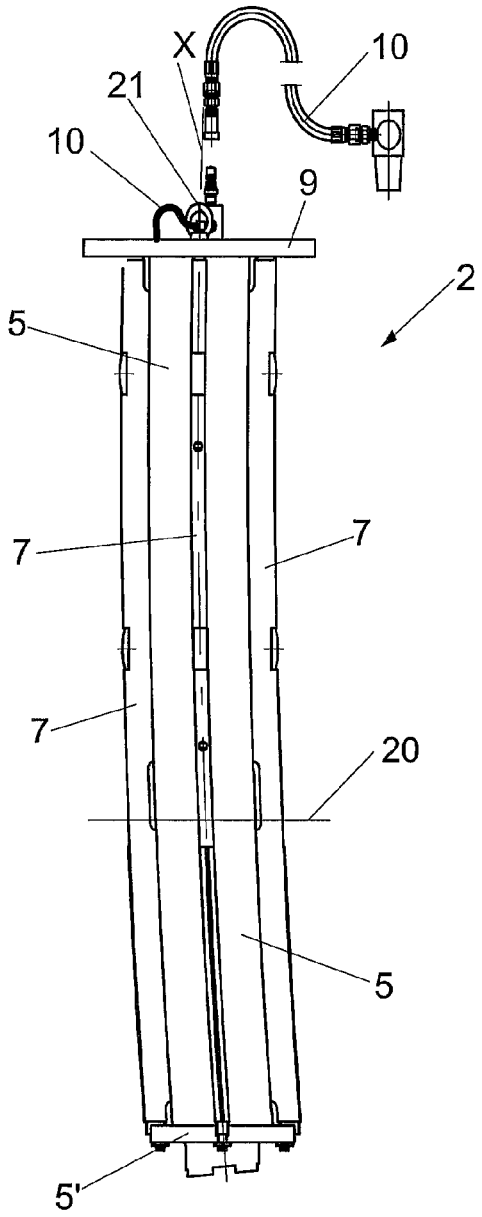
FIG. 2 shows a side view of the template according to the invention.
Figure 3:
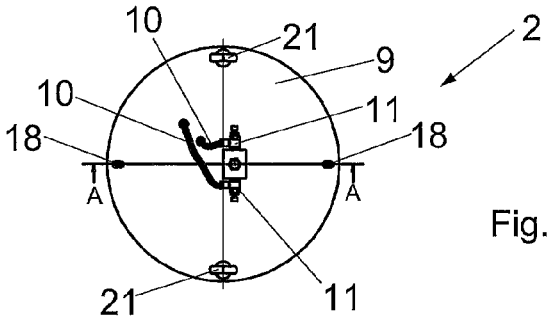
FIG. 3 shows a top view of the template in FIG. 2.
Figure 4:
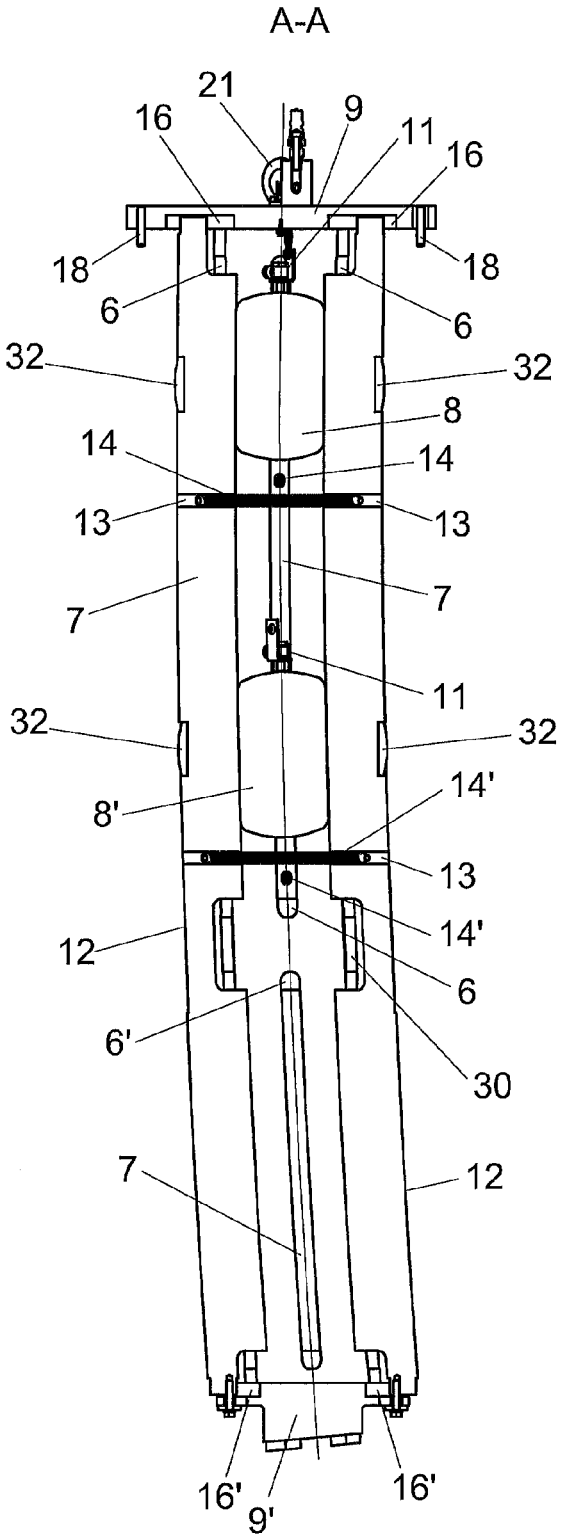
FIG. 4 shows a sectional view along plane A-A of the template in FIGS. 2 and 3.

With reference to FIGS. 2 to 4, a first embodiment of a centering template 2 for centering the rollers at the foot of an ingot mold is shown. Template 2, object of the present invention, is suitable for being accommodated inside a crystallizer having a round transversal section. FIGS. 1*a* and 1*b* show, by way of example, a portion of an ingot mold 1 provided with foot rollers 3 and of a crystallizer 4.

In this first embodiment, the centering template 2 comprises:

- a round section tubular frame 5 defining a longitudinal axis X and having at least one plurality of longitudinal slots 6 on the side surface thereof, which are parallel to axis X and arranged at an equal angular distance from one another;
- a plurality of longitudinal plates 7 configured so that each longitudinal plate 7 is inserted, longitudinally with an inner edge 12' thereof, into a respective longitudinal slot 6 and can move in radial direction through said respective slot 6;
- at least one inflatable chamber, housed inside the tubular frame 5 and at least partially covering the longitudinal extension of a frame stretch adapted to remain inside crystallizer 4 when the template is inserted into the latter, said at least one inflatable chamber being adapted to expand so as to move the longitudinal plates 6 outwards in radial direction to adhere them to the inner wall of the crystallizer.

The round transversal section tubular frame 5 is made in a single piece and is slightly curvilinear, as shown for example in FIG. 4, and the longitudinal axis X thereof is a curved axis.

At the upper end thereof, template 2 is provided with at least one upper flange 9 for resting on the upper part of the ingot mold. The upper flange 9, preferably but not necessarily, has a circular shape and is provided with:

- first fixing means, for example screws or pins 18, by means of which the template is correctly and accurately positioned in the ingot mold;
- a plurality of guides 16 within which the upper ends 17 of plates 7 slide;
- connections to a plant of pressurized fluid, generally air, with which said at least one inflatable chamber is inflated.

At the lower end thereof, template 2 is also provided with at least one lower flange 9' for closing the tubular frame 5. The lower flange 9', preferably but not necessarily, has a circular shape and is provided with a plurality of guides 16' within which the lower ends 17' of plates 7 slide.

As an alternative, the connections to the pressurized fluid plant may be provided on the lower flange 9' rather than on the upper flange 9.

Guides 16, 16', in which the upper ends 17 and the lower ends 17' of plates 7 can slide, respectively, are made in the shape of slots or grooves.

Ends 17, 17' of plates 7 (FIG. 6) have a smaller width W' than the width W of the plate body and are connected to the respective flanges 9, 9' so that plates 7 can only shift in radial direction with respect to the longitudinal axis X of the tubular frame 5.

Figure 5:
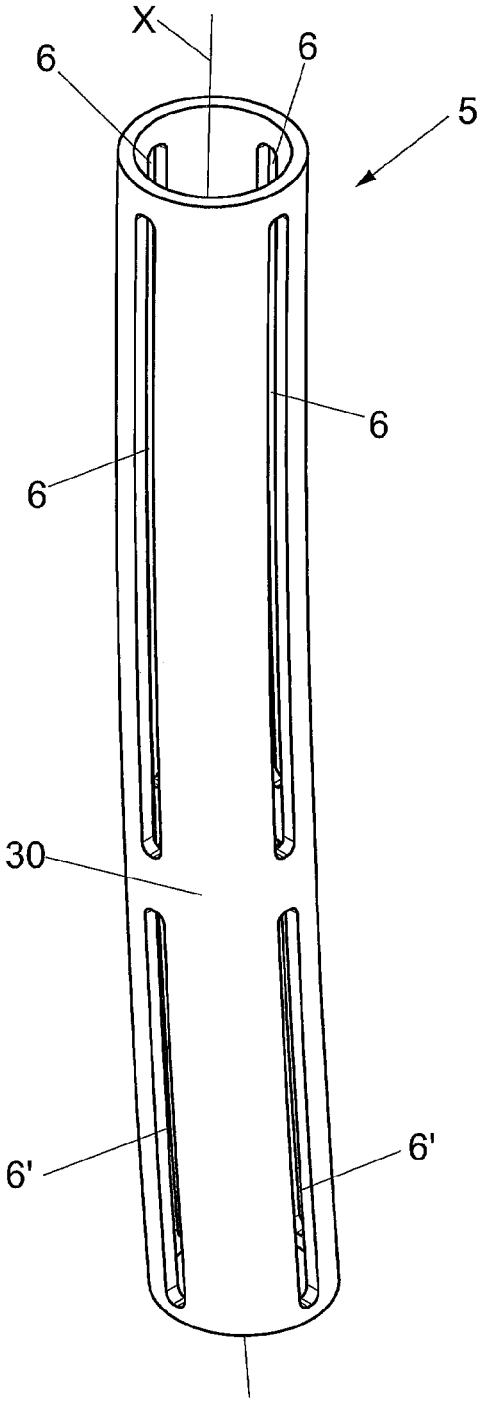
FIG. 5 shows an axonometric view of a first component of the template of the invention.

A preferred variant of the template, object of the present invention, includes the tubular frame 5 provided with two pluralities of longitudinal slots 6, 6' (FIG. 5).

The first longitudinal slots 6, parallel to axis X and arranged at an equal angular distance from one another, are arranged in a first frame stretch adapted to remain inside crystallizer 4 when the template is inserted into the latter. The number of slots 6 preferably is equal to the number of rows of foot rollers to be aligned; therefore, the number of slots is generally four, thus they are spaced apart by 90° from one another.

The second longitudinal slots 6', in a number equal to the number of slots 6, are longitudinally arranged to corresponding slots 6 in a second frame stretch, beneath the first frame stretch and adapted, on the other hand, to remain outside crystallizer 4 when the template is inserted into the latter.

The second slots 6' have a longitudinal extension generally smaller than the first slots 6, since the second frame stretch usually is shorter than the first frame stretch.

The longitudinal plates 7 have such a longitudinal extension as to cover with a first part the whole length of the crystallizer and with a second part the area, outside the crystallizer, where rollers 3 at the foot of the ingot mold are positioned when template 2 is inserted into the crystallizer.

Figure 6:
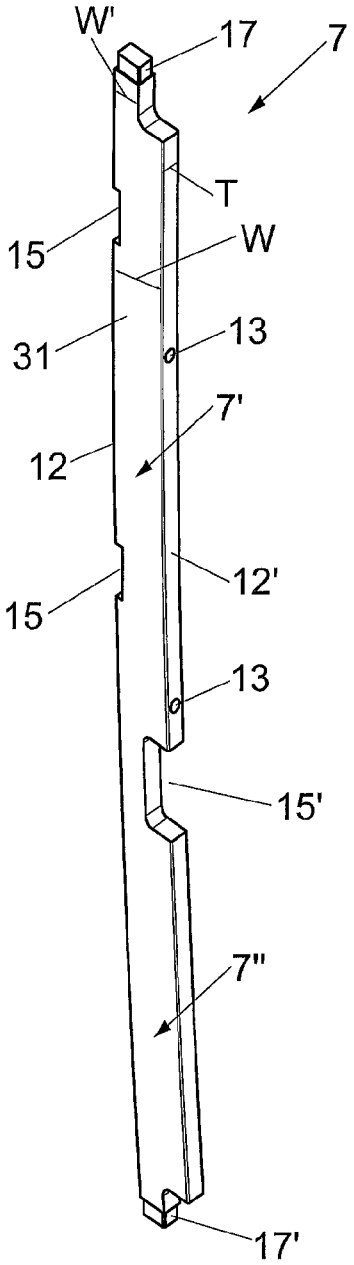
FIG. 6 shows an axonometric view of a second component of the template of the invention.

Plates 7 have an inner edge 12' and an outer edge 12, opposite to each other, and two side faces 31 opposite to each other (FIG. 6). The side faces 31 preferably are perpendicular to edges 12, 12'.

In particular, in addition to the narrowing areas at the ends 17 and 17', the plates 7 have an intermediate recess 15' on the inner edge 12', said recess corresponding to an intermediate stretch 30 of the frame 5 arranged between the first slots 6 and the second slots 6'. In this configuration, the first stretches 7' of plates 7 can radially slide through the first slots 6, the second stretches 7" of plates 7 can radially slide through the second slots 6', while the intermediate recesses 15' of plates 7 accommodate the intermediate stretch 30 of frame 5, thus avoiding any undesired interference during the radial displacement of plates 7.

Width W of the side faces 31 of plates 7 is advantageously of 70-90 mm, preferably of 80 mm, so as to impart a good bending resistance, avoiding the plate from bending when the foot rollers approach it during the alignment thereof.

On the other hand, thickness T of edges 12, 12' is advantageously of 20-30 mm, preferably of 25 mm.

These dimensions allowed optimal centering results of the rollers at the foot of the ingot mold to be obtained. With this template the rollers at the foot of any ingot molds can be aligned in a predetermined range of dimensions according to the frame radius; outside said range the template dimensions must be changed.

In a preferred variant, the template of the invention is advantageously provided with two inflatable chambers, preferably but not necessarily air chambers (FIG. 4). A first air chamber 8 is arranged at the upper end of the template and, thus, at the upper end of the crystallizer inside which the template is positioned. On the other hand, a second air chamber 8' is arranged in an intermediate position between the upper and lower ends of the template, advantageously at the lower end of the crystallizer. Line 20 in FIG. 2 shows, for example, the height corresponding to the lower end of the crystallizer when the template is inserted therein. Therefore, the part of template beneath line 20 remains outside the crystallizer.

These air chambers 8, 8' are kept in the correct positions within template 2 by means of hooks, fixed to the template structure, to which they are hanged.

Respective flexible tubes 10 and quick couplings 11 are provided in the upper part of template 2 for introducing air or other suitable pressurized fluid into chambers 8, 8'.

The outer edges 12 of plates 7, which abut on the inner wall of the crystallizer, have a curved profile with a radius equal or similar to that of the inner surface of the crystallizer.

At each air chamber there are advantageously provided recesses 15 on the outer edge 12 of each longitudinal plate 7; in said recesses 15 there may be accommodated blocks 32 which effectively come into contact with the crystallizer. Shims may be arranged on said blocks 32 in a predetermined manner so as to vary the inclination of plates 7 with respect to frame 5 and to adapt to the curvature of the crystallizer, which may therefore be different from that of the template.

The shims may also be added equally on all blocks 32 of recesses 15 in order to keep plates 7 more internally with respect to the actual inner surface of the crystallizer, spacing them apart by a predetermined distance, for example for casting steels characterized by a higher shrinkage.

Recesses 15, and thus blocks 32, are preferably two for each plate 7 and are provided so as to be close to the crystallizer ends when the template is inserted into the latter.

Blocks 32 are advantageously made of a wear-proof material, while plates 7 are made of a material which, when subjected to mechanical processing, does not get too deformed.

Once the compressed air has been introduced into chambers 8, 8', they expand pushing plates 7 radially outwards from the tubular frame 5 up to the perfect contact of the outer edges 12 or of blocks 32 with the inner wall of the crystallizer. Thereby, the template stiffens by adhering to the inner profile of the crystallizer and providing, for the part protruding outside the crystallizer, a precise abutment on which the adjustment of all the foot rollers can be made, both of the intrados and extrados rollers and of the side rollers.

Advantageously, in the template portion which remains outside the crystallizer, once inserted into the latter, i.e. in the template area where the adjustment of the rollers at the foot of the ingot mold is carried out, the outer edges 12 of plates 7 have the surface accurately processed to provide a precise abutment for aligning the respective foot rollers on the template. In particular, the surface of edges 12 has a profile corresponding to the profile of a portion of the side surface of the rollers so that a perfect contact between the edges 12 and the foot rollers 3 is obtained when the air chambers have been inflated. The foot rollers 3 are then fixed in such a perfect contact position.

For an even higher accuracy, and especially if the rollers are aligned in horizontal rather than vertical position, the template must also be fixed at the lower end by means of a cross flange 40 (FIG. 1*b*), thus restraining the lower part of the template to dedicated seats obtained on a frame 41 of the foot rollers 3, advantageously in a lower area of the last one of said foot rollers 3 (FIG. 1*b*).

A further advantage of the template, object of the present invention, is the fact that respective return springs 14, 14' are provided in proximity of the air chambers 8, 8', said return springs being suitable for facilitating the extraction of the template 2 from the crystallizer once the centering of the rollers at the foot of the ingot mold has been carried out and the air chambers are deflated. Each return spring 14, 14' of plates 7 is fixed, at the ends thereof, at holes 13 respectively made on the inner edges 12' of a pair of longitudinal plates diametrically opposite to each other with respect to the circular section tubular frame 5.

In the variant shown in FIG. 4, a first pair of return springs 14, crossed to each other and defining axes which are perpendicular to each other when viewed in a transversal section, is arranged beneath the first air chamber 8. A second pair of return springs 14', crossed to each other and defining axes which are perpendicular to each other when viewed in a transversal section, is arranged beneath the second air chamber 8'. By deflating the air chambers, the return springs 14, 14', thus arranged, approach plates 7 to each other, avoiding the contact and rubbing of the template with the inner walls of the crystallizer during the extraction of the template from the crystallizer itself.

As an alternative, a good centering of the rollers may also be obtained by using a template provided with a single air chamber therein, which at least partially covers the longitudinal extension of the template stretch which remains inside the crystallizer.

A further aspect of the present invention provides for a method for centering the rollers at the foot of the ingot mold by using the above template. Such a method comprises:

- inserting the centering template 2 into the crystallizer up to resting said at least one flange 9 on the upper part of the ingot mold;
- introducing air or other suitable fluid at a predetermined pressure through the quick couplings 11 into the air chambers 8, 8' so that they expand up to the outer edges 12 of the longitudinal plates 7 contact the inner walls of crystallizer 4, thus obtaining a perfect alignment of the template with said inner walls;
- centering the rollers at the foot by approaching the rollers themselves up to reach a first contact position of the rollers along a generatrix thereof with the respective outer edges 12;
- locking the rollers in this first contact position.

Once this simple, quick and accurate roller centering operation has been completed, the air chambers are deflated by opening the quick couplings 11, causing the removal of plates 7 from the inner walls of the crystallizer, also due to the return force exerted by the return springs 14, 14'. The whole centering template 2 is then extracted from the crystallizer by means of suitable extraction means which grip hooks 21, provided in the upper part of the template 2, advantageously avoiding frictions and rubbings between plates 7 and rollers 3, already centered, which may displace said rollers from the perfectly centered position achieved. The above extraction means also have the function of inserting the template into the ingot mold.

The invention claimed is:

1. A template for centering rollers at a foot of an ingot mold, the ingot mold being provided with a round section crystallizer in which the template can be inserted by passing therethrough from a first end to a second end, the template comprising:

- a round section tubular frame, defining a longitudinal axis and having at least one plurality of longitudinal slots arranged at an equal angular distance from one another;
- a plurality of longitudinal plates configured so that each longitudinal plate is inserted into a respective longitudinal slot and can move in radial direction through said respective longitudinal slot;
- at least one inflatable chamber, housed inside the tubular frame and at least partially covering the longitudinal extension of a first frame stretch adapted to remain inside the crystallizer when the template is inserted into said crystallizer, said at least one inflatable chamber being adapted to expand so as to move said longitudinal plates outwards in radial direction to adhere them to an inner wall of the crystallizer.

2. A template according to claim 1, comprising, at a first end of the tubular frame, a first flange for fixing the template to an upper part of the ingot mold, and comprising a second flange at a second end of said tubular frame; first flange and second flanges being provided with guides for a sliding movement of first ends and second ends of the longitudinal plates in said radial direction, respectively.

3. A template according to claim 2, wherein the guides are made in a shape of slots or grooves.

4. A template according to claim 1, wherein there are included first slots of said plurality of longitudinal slots, parallel to the longitudinal axis and arranged in said first frame stretch, and second slots of said plurality of longitudinal slots in a number equal to the number of the first slots and arranged longitudinally aligned with respect to corresponding first slots in a second frame stretch adapted to remain outside the crystallizer when the template is inserted into said crystallizer.

5. A template according to claim 4, wherein the longitudinal plates are provided, on an inner edge, with an intermediate recess corresponding to an intermediate stretch of the tubular frame arranged between the first slots and the second slots whereby first stretches of the plates pass through the first slots in said radial direction and second stretches of the plates pass through the second slots in said radial direction, while the intermediate recesses accommodate the intermediate stretch of the tubular frame.

6. A template according to claim 1, wherein two inflatable chambers are provided whereby, when the template is inserted into said crystallizer, said two inflatable chambers are arranged in positions corresponding to the first end and to the second end of the crystallizer, respectively.

7. A template according to claim 6, wherein there is provided a first pair of reciprocally crossed return springs arranged under a first inflatable chamber of said two inflatable chambers, and wherein there is provided a second pair of reciprocally crossed return springs arranged under a second inflatable chamber to facilitate the extraction of the template from the crystallizer when an operation of centering the rollers at the foot of the ingot mold has been performed and the inflatable chambers are deflated.

8. A template according to claim 6, wherein at each inflatable chamber there are provided recesses on an outer edge of each longitudinal plate, in which recesses there may be accommodated blocks adapted to come into contact with the inner wall of the crystallizer.

9. A template according to claim 8, wherein at least one shim may be arranged on said blocks to adjust an inclination of the longitudinal plates with respect to the tubular frame and possibly to adapt to a curvature of the crystallizer.

10. A template according to claim 1, wherein, on a template portion which remains outside the crystallizer, a surface of outer edges of the longitudinal plates has a profile adapted to be corresponding to a profile of a portion of a side surface of the rollers so as to obtain a perfect contact between the outer edges and the rollers when the inflatable chambers are inflated.

11. A template according to claim 4, wherein the number of first slots, second slots and longitudinal plates is respectively equal to the number of rows of rollers, preferably four and arranged at 90° from one another.

12. A method for centering rollers at a foot of an ingot mold provided with a crystallizer, by using a template according to claim 1, comprising the following steps:

a) inserting the template into the crystallizer;

b) expanding at least one inflatable chamber whereby the longitudinal plates of the template move radially outwards, through the tubular frame, up to produce a contact of said longitudinal plates with inner walls of the crystallizer;

c) centering the rollers at the foot by approaching the rollers up to reach a position of first contact of said rollers along a generatrix thereof with said longitudinal plates.

13. A method according to claim 12, wherein step b) includes introducing a fluid at a predetermined pressure into at least one inflatable chamber so that the latter expands up to produce said contact of the longitudinal plates with the inner walls of the crystallizer.

14. A method according to claim 13, wherein step c) is completed by locking the rollers (3) in said position of first contact and in step a) the template is inserted into the crystallizer until at least one flange thereof rests on an upper part of the ingot mold.

* * * * *